US005666775A

United States Patent [19]

Shreiner et al.

[11] Patent Number: 5,666,775

[45] Date of Patent: *Sep. 16, 1997

[54] EXPANSION JOINT COVER

[75] Inventors: Thomas A. Shreiner, Picture Rocks; Roger W. Barr, Williamsport, both of Pa.

[73] Assignee: Construction Specialties, Inc., Cranford, N.J.

[ * ] Notice: The term of this patent shall not extend beyond the expiration date of Pat. No. 5,611,181.

[21] Appl. No.: 568,354

[22] Filed: Dec. 6, 1995

Related U.S. Application Data

[63] Continuation-in-part of Ser. No. 340,036, Nov. 14, 1994, Pat. No. 5,611,181.

[51] Int. Cl.[6] ..... E04B 1/68

[52] U.S. Cl. ..... 52/396.04; 52/396.05; 52/396.06; 52/396.08; 52/396.09; 52/573.1; 52/DIG. 13

[58] Field of Search ..... 52/573.1, DIG. 13, 52/396.04, 396.02, 396.05, 396.06, 396.08, 396.09; 404/47, 67, 68; 14/73.1

[56] References Cited

U.S. PATENT DOCUMENTS

| | | | |
|---|---|---|---|
| 3,371,456 | 3/1968 | Balzer et al. . | |
| 3,992,121 | 11/1976 | Geiger . | |
| 4,430,835 | 2/1984 | Ericson | 52/DIG. 13 X |
| 4,691,478 | 9/1987 | Lorg | 52/DIG. 13 X |
| 4,801,143 | 1/1989 | Heddon | 52/DIG. 13 X |
| 4,893,448 | 1/1990 | McCormick . | |
| 5,134,822 | 8/1992 | Edlin | 52/DIG. 13 X |

FOREIGN PATENT DOCUMENTS 614711 12/1948 United Kingdom .

*Primary Examiner*—Christopher Todd Kent

[57] ABSTRACT

An expansion joint cover for concealing an expansion gap between building members comprises retainers attached to building members on each side of the expansion gap and a cover panel spanning the expansion gap and overlying at least portions of the first and second retainers and a portion of the building member on at least one side of the gap. The cover panel is attached to the retainers by axially releasable fasteners, such as hook and loop fasteners.

25 Claims, 14 Drawing Sheets

EXPANSION JOINT COVER

This application is a continuation-in-part of U.S. patent application Ser. No. 08/340,036 filed Nov. 14, 1994, now U.S. Pat. No. 5,611,181.

BACKGROUND OF THE INVENTION

Expansion joint covers for buildings in geographic regions that are prone to earthquakes are commonly of special designs that allow for movements of the building elements on either side of the expansion gap that are very much greater than the movements that occur as a result of thermal expansion and contraction. Most seismic expansion joint covers follow traditional design philosophies that have long been applied to expansion joint covers that are not intended to sustain earthquakes; they use metal cover panels and various fastening systems to join the cover panels to frame members that are attached to the building members on either side of the expansion gap in such a way as to retain the cover panels in place in the gap during seismic events while permitting the large motions of the members.

In a commonly used fastening system, the cover panel is attached by bolts to the centers of spaced-apart bridge bars that span the gap with their ends sliding in trackways in the frame members. As the gap expands and contracts, the bridge bars pivot about the connecting bolts. An example of a seismic expansion joint cover system that uses bridge bars is found in Moulton U.S. Pat. No. 5,078,529 issued Jan. 7, 1992, for "Seismic Expansion Joint Cover."

Previously known seismic expansion joint covers can sustain relatively weak earthquakes but are severely damaged, often beyond repair, in severe earthquakes, such as the one that occurred in January, 1994, just north of Los Angeles, Calif., U.S.A. An inspection of several installations of seismic expansion joint covers of various designs in the Los Angeles area just after that earthquake revealed bent and mangled cover panels, failed connectors, frames ripped from their anchors in the walls and floors, and damage to the walls adjacent the covers caused by impacts of the partially detached cover panels against the walls. Few of the inspected installations were repairable.

SUMMARY OF THE INVENTION

One object of the present invention is to provide an expansion joint cover for walls and ceilings having a cover panel is very easy to install initially and to replace, should it be damaged, and that releases from a retainer system in the event of a widening or narrowing of the expansion gap to an extent that exceeds a predetermined normal range due to temperature changes. Another object is to provide and expansion joint cover that, because it is releasable from the retainer system, is able to sustain a severe earthquake with little likelihood of damage to the cover panel or to the wall or ceiling in which it is installed. Another object is to provide an expansion joint cover in which the cover panel can be quickly and easily reinstalled after it becomes detached in a seismic event. Still another object is to provide an expansion joint cover that is inexpensive and attractive in appearance. It is also desired that an expansion joint cover, according to the present invention, be fire retardant and have a cover panel that is of a low mass and minimizes noise transmission.

The foregoing objects are attained, in accordance with the present invention, by an expansion joint cover that includes a first retainer attached to a building member on one side of the expansion gap, a second retainer attached to a building member on the other side of the expansion gap, and an elongated cover panel having an internal face, an external face and side edges and having a width such that it spans the expansion gap and overlies a portion of a building member (a wall or ceiling) on at least one side of the gap. The invention is characterized in that at least two axially releasable fasteners join the cover panel to at least one of the retainers, the fasteners being spaced apart longitudinally of the cover panel. As used herein, the term "axially releasable fastener" means a connector that joins one member to another member in a manner such that the connection is undone and the members are released from one another solely by applying a force to one member acting substantially unidirectionally along an axis in a direction away from the other member. Examples of "axially releasable fasteners" are "hook and loop cloth," snap fasteners, various forms of spring clips and releasable forms of "snap together" fasteners, magnets and gravity clips. An important aspect of the present invention is the automatic release of the cover panel from the retainer system in the event of a seismic event. An additional benefit of the ability of the fasteners to release the cover panel is ease of initial installation and, if necessary, removal of the cover panel for replacement. Accordingly, the expansion joint cover of the present invention is useful for not only expansion joints in buildings designed for earthquake-prone regions but for expansion joints in buildings of conventional design.

In a preferred embodiment, at least two first axially releasable fasteners join the cover panel to the first retainer, the first fasteners being spaced apart lengthwise of the cover panel. At least two slide tracks are attached to the internal face of the cover panel in spaced-apart relation lengthwise of the cover panel, each slide track being perpendicular to the longitudinal axis and being positioned to overlie the second retainer. A movable slider is received in each slide track for movement along the track, and a second releasable fastener joins each slider to the second retainer.

In preferred embodiments, at least one tether, such as a flexible cable or cord, which may also be elastic, connects the cover panel to the wall or ceiling adjacent the expansion gap so as to retain the cover panel proximate to the wall or ceiling in the event of release of the fasteners. Accordingly, the cover panel is kept from falling to the floor and becoming an obstacle to movement of persons and things. In some embodiments, the tether allows the cover panel to move away from the retainer system. In the case of a ceiling cover, it is preferred to use a loose tether of that form so that the cover panel will not interfere with adjacent wall cover panels. In the case of a wall cover panel, an advantageous tether arrangement is a system of two or more resilient flexible elements that extend across the expansion gap in spaced apart relation and are joined to the cover panel. The flexible elements hold the cover panel against the wall and form a fence that keeps the cover panel from entering the expansion gap, even if the gap widens to a width greater than the width of the cover panel. A preferred flexible element is a "shock cord." It is also possible to use one or more non-elastic cords suitably strung across the expansion gap, attached at each crossing to the cover panel, and tensioned by weights or mechanical springs.

In some embodiments, each slide track is recessed into the internal face of the cover panel, at least one edge of the cover panel slidably engages or is close to a surface of a building member on one side of the expansion gap, and the second retainer has a surface substantially flush with the surface of the building member. Where the gap occurs at a corner, only one surface of the building member is engaged by or is close to the cover panel. Otherwise, the cover panel engages or is close to surfaces on both sides of the gap. In some installations, the surfaces on either side of the gap are planar surfaces of a continuous wall or ceiling. In other installations, the surface of the building member engaged by one or both edges of the cover panel is a surface of a recessed portion of the wall or ceiling, in which case the external surface of the cover panel may be flush with the portions of the wall or ceiling adjacent the recesses.

Each slide track may extend across the cover panel such that a portion overlies the first retainer, and a non-movable slide member is received in each slide track in said portion and is fixed therein against movement. In that case, each first axially releasable fastener is connected between a non-movable slider and the first retainer. Slide tracks that span the cover panel widthwise provide lateral stiffness to the cover panel, provide enhanced retention of the releasable fasteners, and facilitate maintaining desired locations of the releasable fasteners during manufacture, particularly in the thickness direction because of the recessing of the slide tracks.

In embodiments in which the cover panel is surface-mounted, the cover panel will ordinarily have a substantially uniform profile in transverse cross-section along its length and will, preferably, be somewhat thicker at or near the longitudinal center than adjacent the edges. The thinner edges present the appearance of a thin profile in a surface-mounted installation. The external face of the cover panel may be convexly curved laterally and the internal face substantially planar.

The cover panel may be made by compression-molding of a composite material that includes a fiber filler, such as glass fibers, and a suitable binder. The external face of the cover panel may have a covering of a sheet material, such as a synthetic textile fabric (e.g. a woven polyester), or a heavy paper, that is adapted to receive paint or wallpaper. Alternatively, the cover panel also can be built up from a skeletal frame that includes slide tracks and roll-formed or brake formed metal skins, metal sheet stock, or panels of a polymeric material, which can be thermoformed.

It is advantageous, though not necessary, in surface-mounted versions and highly desirable in flush-mounted versions, to provide an arrangement for displacing the cover panel away from the wall to cause the fastener system to release the cover panel from attachment to the retainers. In one arrangement, at least one deflector member extends from the internal surface of the cover panel. the deflector member is positioned and formed so as to engage a retainer and effect detachment of the fasteners. In a flush-mounted design, one or both side edges of the cover panel may be beveled so that they present a sloping surface that provides a camming action against the shoulder formed by the side edge of the recess in which the cover panel is received. Alternatively, the side edge of the recess may be sloped to provide the camming action against the cover panel. In such arrangements, the wall recess may be formed by a portion of the retainer that has a base wall and a sloped side wall.

When the cover panel is recessed into a wall or ceiling, the recesses on either side may be left uncovered to provide reveal surfaces or a flexible gasket may be connected between each edge of the cover panel and an edge of a surface adjacent the recessed portion of the building member. The gaskets may be of the type described and shown in the Shreiner U.S. Pat. No. 5,048,249, issued Sep. 17, 1991, for "Gasket For Flush Expansion Joint Cover," which is incorporated herein by reference. Those gaskets may be designed to detach relatively easily from receiving grooves along the edges of the cover panel and receiving grooves in wall-side gasket retainers. Recessed cover panels are, preferably, of substantially uniform thickness throughout and have external surfaces that are substantially flush with the wall or ceiling surfaces adjacent the recessed portion.

An important and highly advantageous characteristic of a seismic expansion joint, according to the present invention, is that the cover panels are permitted by the fasteners to become completely detached from the building members, except for being tethered by flexible cords to keep them from falling to the floor and getting in the way after they have become detached. The detachment from the retainers is a departure in principle from previously known seismic expansion joint covers, such as those in which the cover panels are resiliently retained in a manner that allows them to move out of the gap when the gap closes but are also pulled back into the gap when the gap opens or cover panels that are designed to permit large movements but remain in place. The previously known covers have proven to be largely incapable of surviving a major earthquake without damage, often irreparable damage.

Another advantage of the expansion joint covers of the present invention is the ease with which they can be restored to their installed state after detachment. All that is required is to place them in proper position and when hook and loop fasteners are used, push them firmly toward the wall or ceiling at the locations of the fasteners. The preferred hook and loop fasteners, as described below, emit an easily detected "snap" or "pop" when they are connected. If a cover panel is damaged, it is removed by simply disconnecting the tether. Previously known seismic expansion joint covers require removal of screws or bolts, such as screws by which the cover panels are fastened at intervals to bridge bars.

Cover panels made of composite materials or built up from cores and skins are light in weight and yet strong and stiff. They are easy to transport and handle, and are of low mass, which reduces the possibility of harming wall and ceiling surfaces when they are detached and everything is shaking to and fro and of becoming a hazard to pedestrians. They are also fire retardant. Cover panels of composite materials have good acoustical properties, which is important in preventing transmission of noise, such as "street noise," through the expansion joint. Fabric or heavy paper coverings permit painting and wall-papering of the cover panels to match the walls, both upon initial installation and upon redecorating.

For a better understanding of the invention, reference may be made to the following description of exemplary embodiments, taken in conjunction with the accompanying drawings.

DESCRIPTION OF THE EMBODIMENTS

Figure 1:
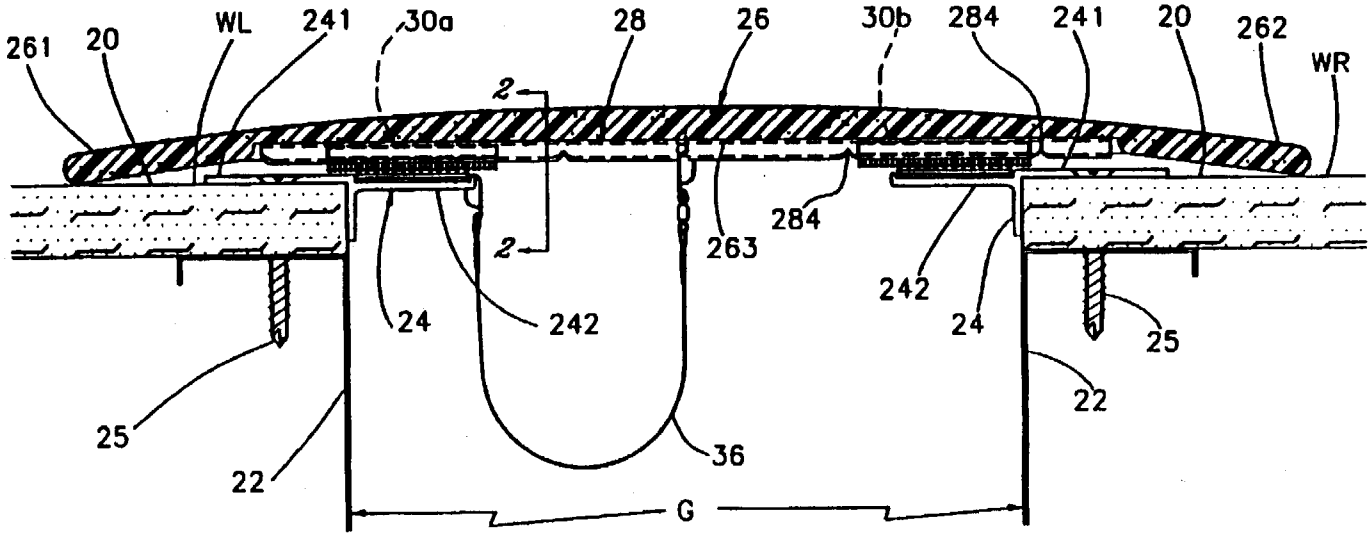
FIG. 1 is an end cross-sectional view of a first embodiment, showing the expansion gap at a neutral width.
Figure 2:
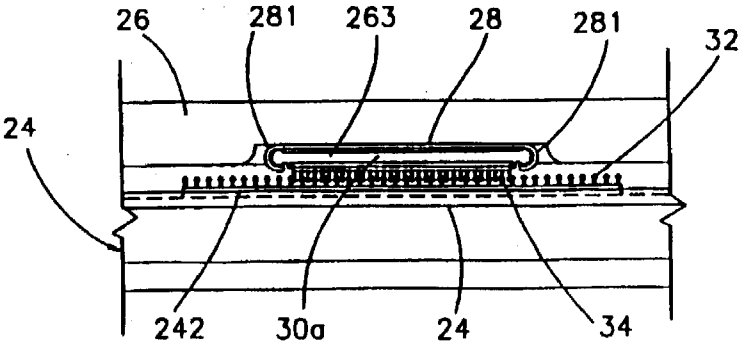
FIG. 2 is a detail side cross-sectional view taken along the lines 2—2 of FIG. 1.

The embodiment of FIGS. 1 to 5 is designed for mounting on the surfaces of two portions WL and WR of a wall or ceiling. For convenience, a building wall or ceiling is referred to hereinafter as a "wall," with the understanding that the expansion joint covers of the present invention are equally useful for ceilings. The wall surfaces are, for example, the faces of gypsum wallboard panels 20, which are fastened to sheet metal studs 22. The expansion joint cover bridges and conceals an expansion gap G between the wall portions WL and WR.

An elongated retainer 24 is fastened to each wall portion WL and WR on either side of an expansion gap by sheet metal screws 25 that pass through a leg portion 241 that overlies the edge of the wallboard panel. A leg portion 242 of each retainer 24 projects out into the expansion gap. Although it is preferred to use retainers that extend continuously along substantially the entire length of the expansion gap, it is possible to use retainer brackets located at suitable intervals along the gap.

A cover panel 26 spans the gap widthwise and extends along the entire length of the gap. Portions along each side edge 261 and 262 of the cover panel overlie portions of the wall surfaces adjacent the gap G. The cover panel 26 is compression molded from a composite material, which contains fibers, such as glass fibers, bonded by a suitable binder, such as a formaldehyde. The cover panel is of uniform profile in transverse cross-section along its length, is thicker at its center than along the edges 261, 262, and is slightly cupped transversely so as to present a slightly convexly curved external surface. The relatively thin edges and the smooth curvature present a "thinline" appearance to an observer. A heavy paper of the type used on gypsum wallboard or a textile fabric covers the exposed surfaces of the cover panel so that the surfaces can be painted or wallpapered to match or coordinate with the wall surfaces.

Recesses 263 are molded into the internal or back surface of the cover panel 26 at suitable intervals along its length. Each recess receives a slide track 28, which is generally channel-shaped and include a flange portion 281 along each side (FIG. 2) that forms an undercut edge groove. The slide tracks 28 may be pieces cut from an extrusion of metal or plastic or from a brake-formed or roll-formed metal band and are suitably fastened to the cover panel 26, such as by adhesive bonding. Each slide track is somewhat longer than the width of the expansion gap and receives a pair of sliders **30*a* and 30*b*, which are, preferably, pieces cut from an extrusion of a polymeric material, such as polyvinyl chloride, and are shaped and dimensioned in cross section so as to be retained in the slide track and to slide along the slide track. One of the sliders 30*b* is, however, secured in the slide track against movement by crimps 284 in the flange portions 281** of the slide track.

A piece 32 of one element of a hook and loop fastener is fastened, such as by adhesive bonding, to the leg portion 242 of each retainer at each location along the length of the retainer that is crossed by a slide track 28 of the cover panel. The leg portion 242 has a shallow recess into which the base sheet portion of the fastener element fits, thereby providing a mechanical attachment against shifting or peeling in the plane of the walls. A piece 34 of the other element of the hook and loop fastener is attached, such as by adhesive or thermal bonding to each slider **30*a*, 30*b***. A suitable hook and loop fastener is available from 3M Industrial Tape and Specialties Division of St. Paul, Minn., U.S.A., as Type 400 "Dual Lock" reclosable fastener. Both elements of that fastener have mushroom-like stems that interengage to provide a highly tenacious releasable connection. The stems are also durable and can be released and refastened numerous times with no significant loss of tenacity. While less preferred, magnets, gravity clips and other axially releasable fasteners can be substituted for hook and loop fasteners.

Each retainer 24 has a hole for one end of a tether 36, such as a steel cable or elastic shock cord. Elastic shock cord has the advantage of absorbing energy and reducing the forces acting on the connection points between the tether and the cover panel and retainer. Each slide track 28 has a hole for the other end of the tether. Each tether has snap hooks 361 at each end that allow it to be connected to a hole in a slide track and a hole in the retainer. Generally, it is desirable to use two tethers for the cover panel, one near each end. In a wall installation, a single tether near the top may suffice.

The cover panel 26 is installed on a wall or ceiling, to which the retainers 24 with the fastener elements 32 in place have been previously attached on either side of the expansion gap G, by first attaching the tethers 36 between the retainer and tracks and then simply lining up the edge of the cover panel closest to the non-movable sliders **30*b* at the proper distance from the gap G, which may be temporarily marked with light pencil marks or pieces of masking tape. Each movable slider 30*a* is moved along the slide track to a position such that it will register widthwise with the fastener element to which it will be affixed, which will vary depending on the width of the expansion gap at the time of installation and can be measured. After the adjustment of the movable sliders 30*a* and positioning of the cover panel relative to the gap, the cover panel is pushed firmly toward the wall at locations near each fastener. The fasteners emit a snap or pop noise as the mushroom stems interengage, which signals proper connection. In the installed condition, the edges 261 and 262** of the cover panel slidably engage, or just clear, the exposed wall surfaces.

Figure 3:
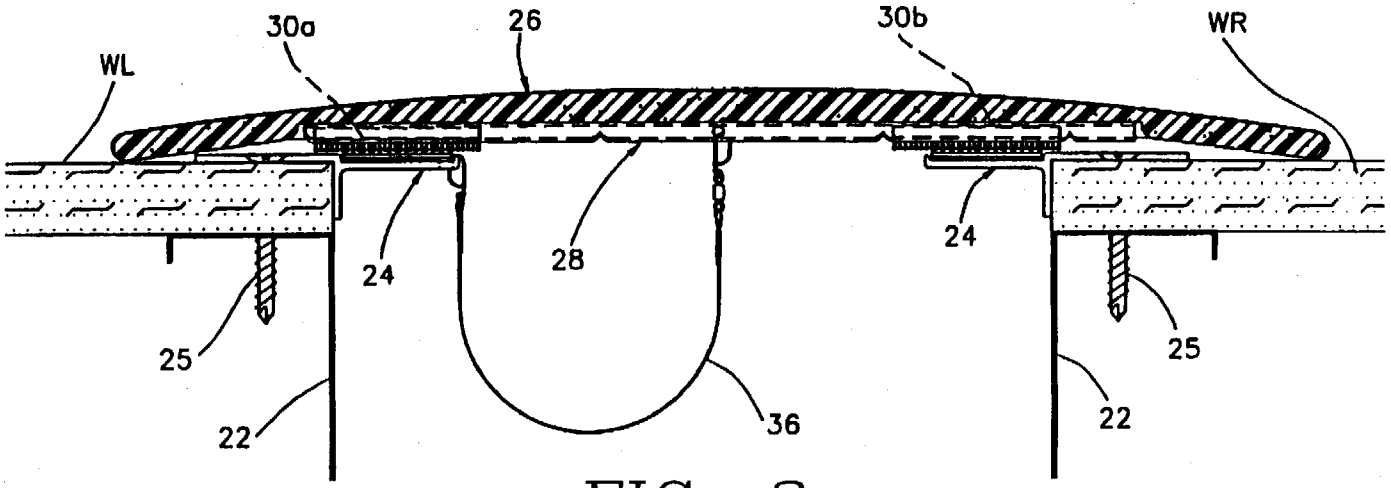
FIG. 3 is an end cross-sectional view of the first embodiment, showing the expansion gap at its greatest normal width.
Figure 4:
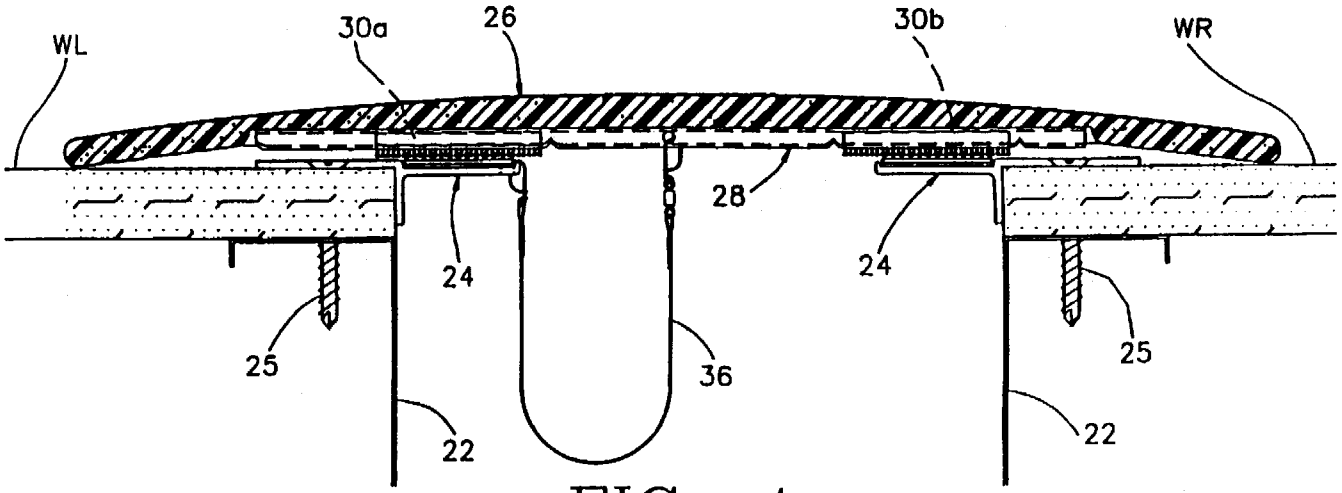
FIG. 4 is an end cross-sectional view of the first embodiment, showing the expansion gap at its smallest normal width.

Normal expansions and contractions of the gap with thermal changes are accommodated by the seismic expansion joint by movements of the movable sliders along the slide tracks, as shown in FIGS. 3 and 4. The non-movable slider 30*b* maintains the cover panel in register with the gap widthwise so that it cannot drift to one side or the other as the gap expands and contracts over successive cycles—one edge of the cover panel remains stationary widthwise.

Figure 5:
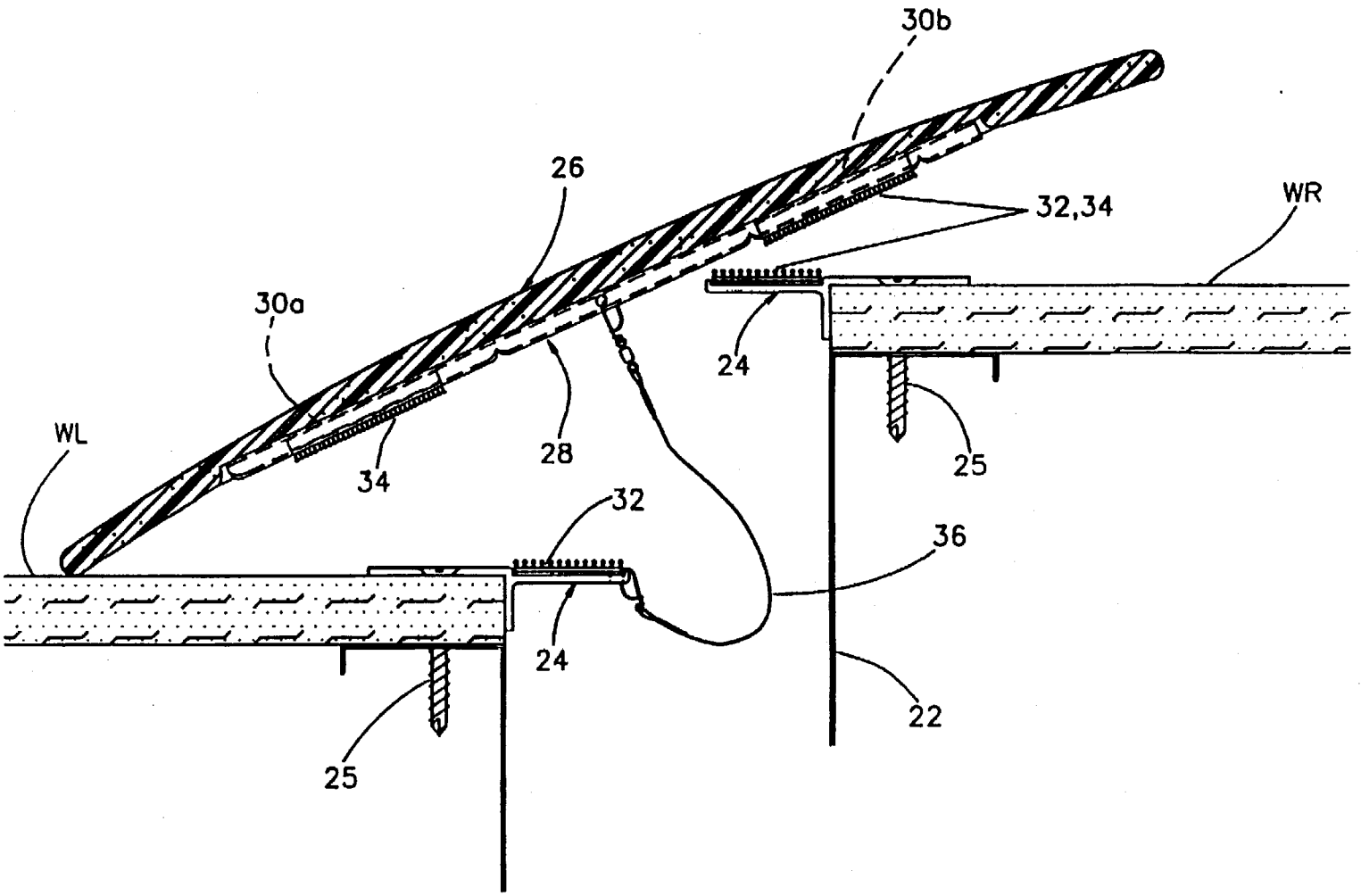
FIG. 5 is an end cross-sectional view of the first embodiment, showing the cover panel detached from the retainers, such as occurs during an earthquake.

In an earthquake, the fasteners release the cover panel so that it can fall away from the wall and ceiling, as shown in FIG. 5. To ensure disengagement of the cover panel when the portions of the building on either side of the gap move predominantly in the plane of wall surfaces, a deflector of the form shown in FIG. 7 and described below can be attached to each track. The tethers 36 keep the cover panel from falling to the floor and becoming an impediment to persons or objects moving in the area of the gap. After the earthquake, the cover panel can usually (absent damage) be reinstalled in the same manner as it was first installed. If a cover panel is damaged, it can be removed by unhooking it from the tethers 36 and a new cover panel installed.

Figure 6:
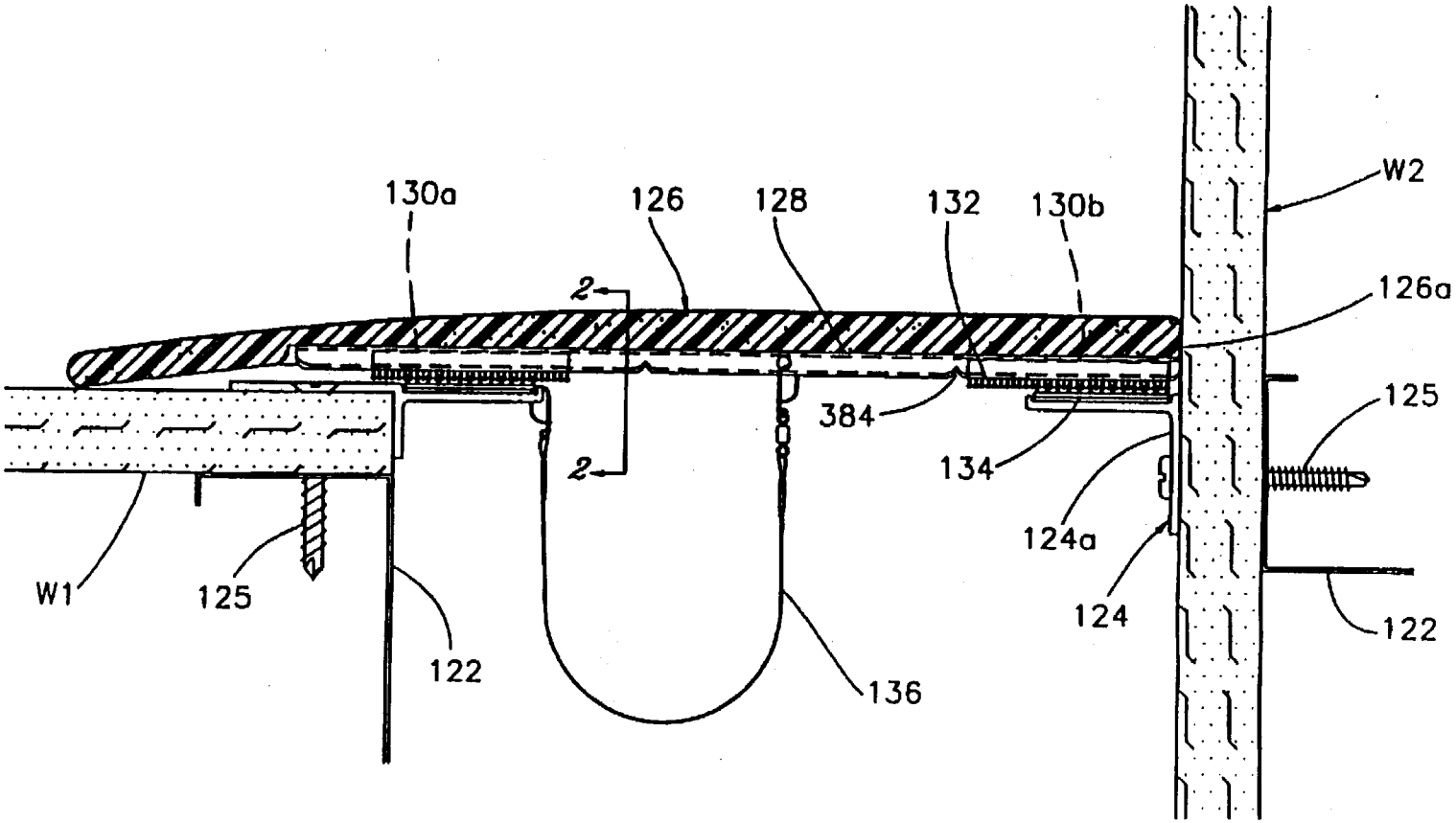
FIG. 6 is an end cross-sectional view of a second embodiment, which is structured for use at a corner.

The embodiment of FIG. 6 is in most respects the same as the embodiment of FIGS. 1 to 5. Accordingly, only the differences are described below, and the parts are given the same reference numerals as those of FIGS. 1 to 5 but increased by 100. The expansion joint cover panel of FIG. 6 is designed for use where the expansion joint occurs at a corner between walls W1 and W2 or where a wall meets a ceiling. In the latter case, the structure of the wall and ceiling will differ from those shown but the design of the expansion joint cover will be essentially the same. The drawing can be inverted to enable a ceiling installation to be visualized more easily. In the expansion joint cover of FIG. 6, one retainer 124 is L-shaped and is fastened by one leg 124*a* to the wall W2, and the cover panel 126 is reconfigured in width and shape to present an edge 126 that abuts the wall W2. The slider 130*b* is held non-movable by crimps 384 in the track 128 so that the cover panel remains stationary relative to the wall W2. Normal expansion and contraction of the gap is accommodated by movement of the movable slider 130*a* along the slide track 128.

Figure 7:
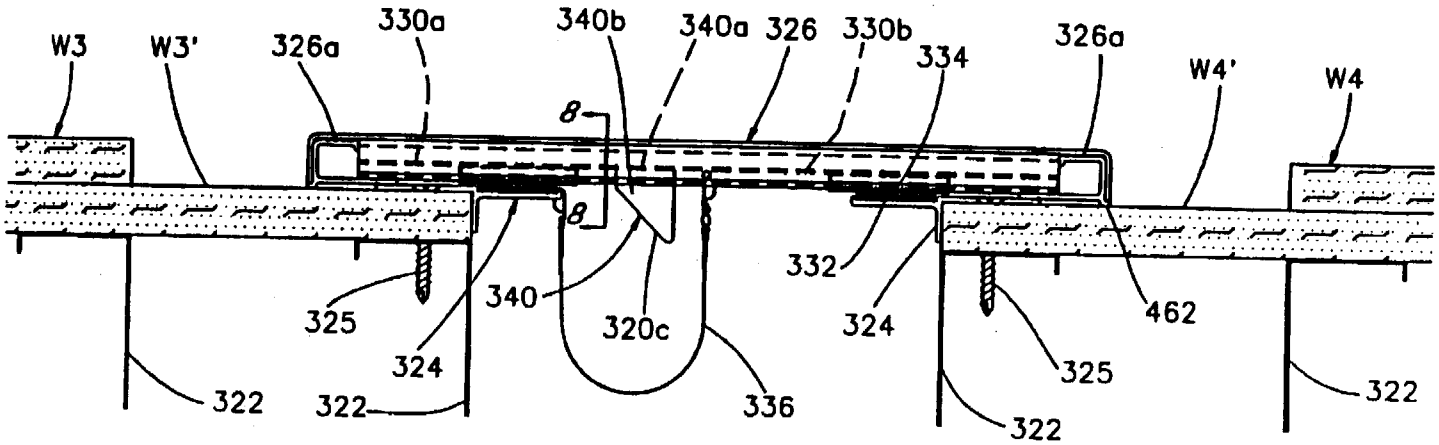
FIG. 7 is an end cross-sectional view of a third embodiment, which is a flush-mounted version.
Figure 8:
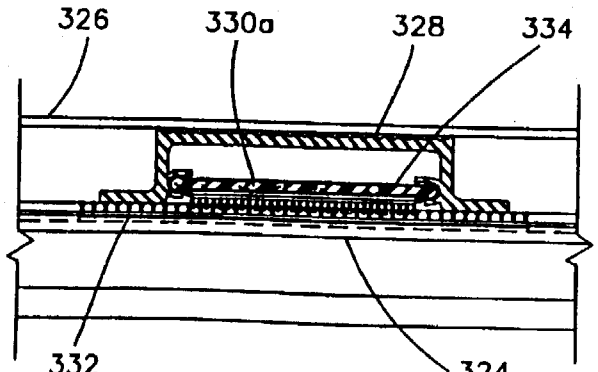
FIG. 8 is a detail side cross-sectional view of the third embodiment, taken along the lines 8—8 of FIG. 7.

The expansion joint cover shown in FIGS. 7 and 8 is configured for mounting flush with the surfaces of walls W3 and W4 or ceilings (not shown). Portions W3' and W4' of the walls on either side of the gap are recessed and provide 5 reveal surfaces. In FIGS. 7 and 8 the components equivalent to those of FIGS. 1 to 5 are designated by the same reference numerals but increased by 300. Retainers 324 are fastened by sheet metal screws 325 to metal studs 322 and receive at intervals along their lengths one element 332 of a hook and loop fastener. The cover panel 326 is built up from a skeletal frame composed of a pair of longitudinal members 326*a* of generally J-shaped cross section along each side and slide tracks 324 located at intervals along the length of the cover panel and extending transversely of the cover panel. A facing member 326*b* of sheet material formed to a channel-shaped cross-section fits over the skeletal frame. Adhesives and/or mechanical fasteners are used to join the cover panel components.

The components of the cover panel can be of metal, such as aluminum, or of polymeric materials, such as polyvinyl chloride, which may be blended with a small amount of an acrylic polymer to increase its toughness. Other materials suitable for the cover panel include high density molded polymeric foam; wood; laminates of foam, such as polystyrene, with a cover sheet of metal or a rigid or semi-rigid polymer; laminates or metal or polymeric sheets with metal or polymeric honeycomb cores; and extruded aluminum or polymeric materials.

Each slide track receives a movable slider 330*a* near one end and a non-movable slider 330*b* near the other end. Each slider is attached to one of the retainers by a hook and loop fastener, one element 332 of which is secured to the retainer and the other 334 to the slider. Tethers 336 keep the cover panel 326 from falling to the floor when the cover panel is dislodged in an earthquake.

The embodiment of FIGS. 7 and 8 includes another feature, which may be incorporated into any design of expansion joint cover embodying the present invention. Each slide track 328 receives a deflector 340 having a mounting base 340*a* affixed to the slide track and a keel-like cam 340*b* having a sloping cam edge 340*c* that faces the side of the expansion gap that is movable relative to the cover panel. In an earthquake, a closing of the gap to a degree greater than a normal narrowing due to thermal contraction brings the retainer 324 into engagement with the cam edge 340*c* of the deflector 340 and pushes the cover panel away from the wall W3, thereby releasing the fasteners on the moving side of the gap. When the deflector pushes the cover panel away from the wall recess W3', the fasteners on the other side of the gap are also released by pivoting of the cover panel about the edge 462 that engages the wall recess W4'.

Figure 9:
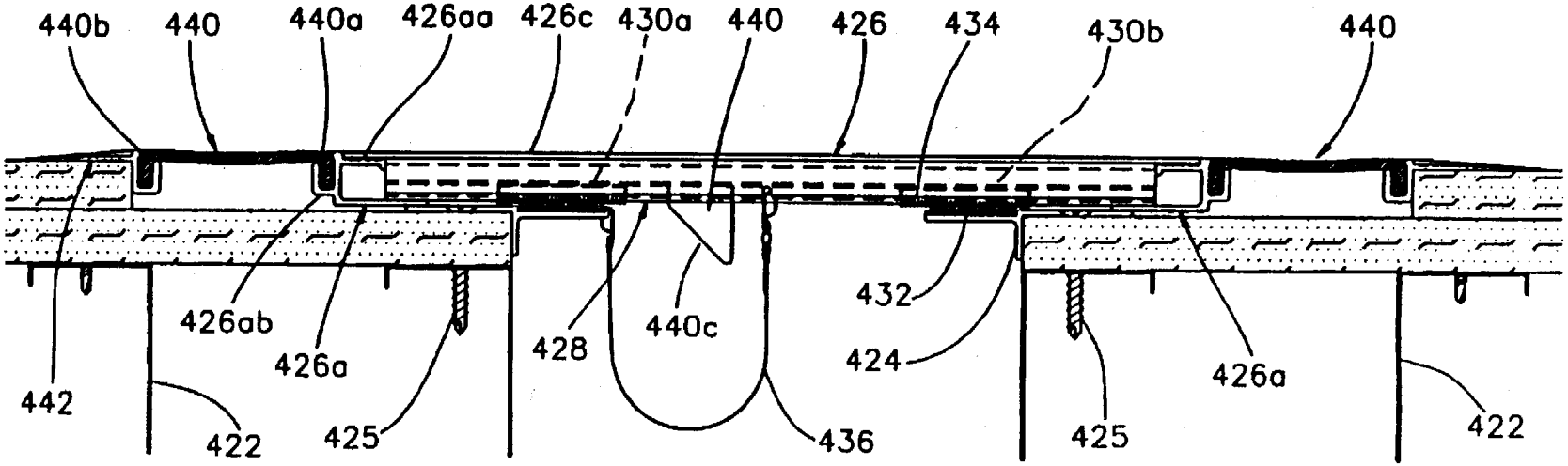
FIG. 9 is an end cross-sectional view of a fourth embodiment, which is also a flush-mounted version and includes gaskets.

The expansion joint cover of FIG. 9 is similar in most respects to that of FIGS. 7 and 8. Therefore, the same references numerals are applied to FIG. 9 as are applied to FIGS. 7 and 8 but increased by 100. The cover panel 426 is built based on a skeletal frame composed of transverse slide tracks 428, a lengthwise member 426*a* along each side edge, and a facing member 426*c*, which in this case is a flat sheet that sets into a recess in a flange portion 426*aa* of each member 426*a* and is bonded to it by an adhesive. An L-shaped flange 426*ab* on each member 426*a* forms a groove that receives one retaining leg 440*a* of a flexible gasket 440. The other retaining leg 440*b* of the gasket is received in a wall retainer 442. As mentioned above, the gaskets may be of the type described and shown in U.S. Pat. No. 5,048,249.

Figure 10:
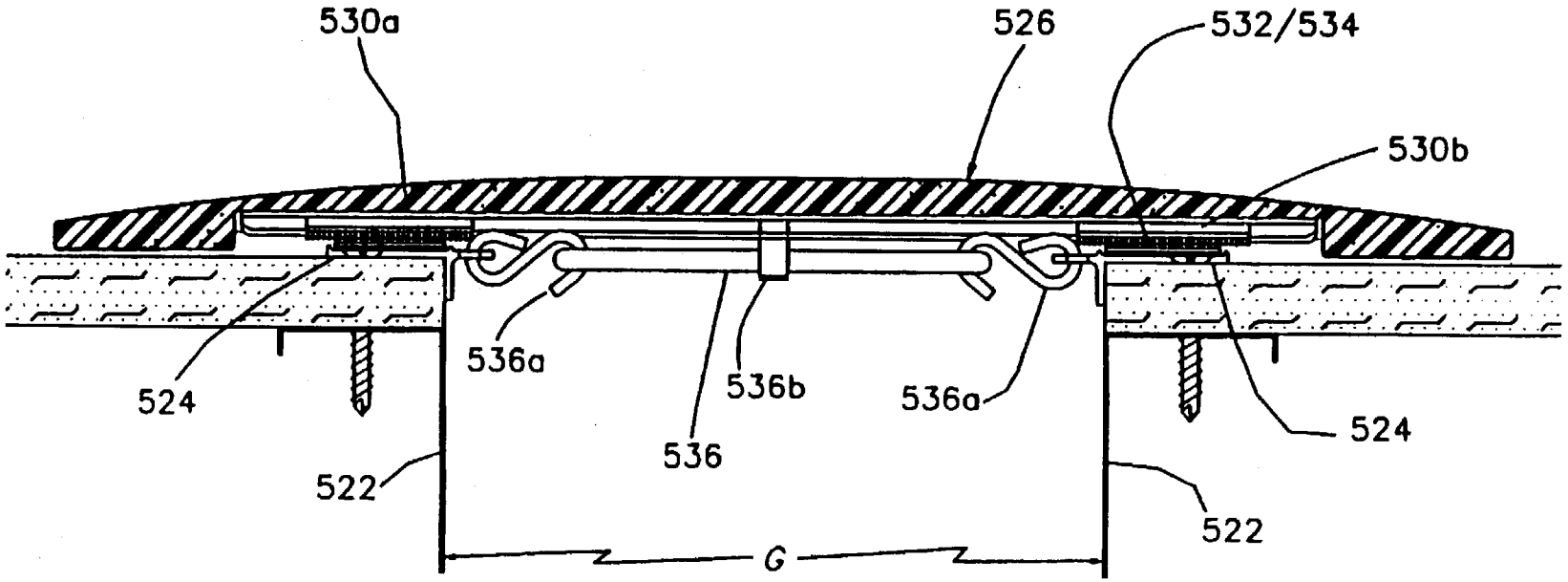
FIG. 10 is an end cross-sectional view of a fifth embodiment, which is a surface-mounted version similar to the embodiment shown in FIGS. 1 to 5.
Figure 11:
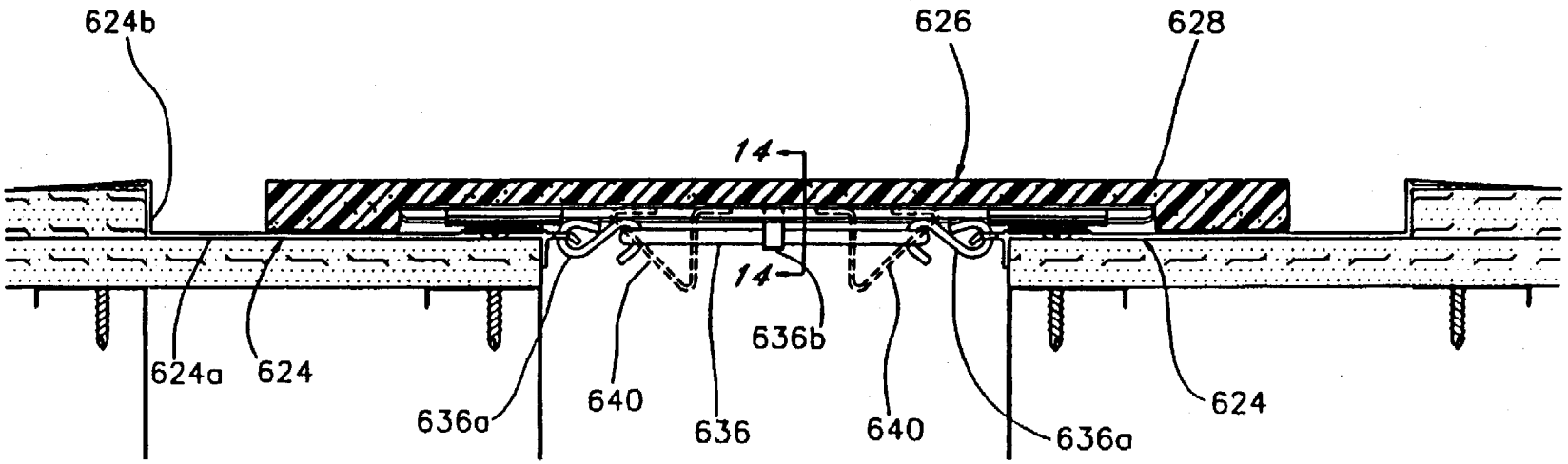
FIG. 11 is an end cross-sectional view of a sixth embodiment, which is a flush-mounted version.

FIG. 10 is a surface-mounted version similar to that of FIGS. 1 to 5, the components of FIG. 10, therefore, being designated by the same references numerals as those of FIGS. 1 to 5 but increased by 500. One element of each hook and loop cloth fastener pair 532/534 is attached to a base portion of each retainer 524 that overlies the edge of the wall adjacent the gap, which differs in detail but not in principle from the arrangement of FIGS. 1 to 5. The molded fiberglass cover panel 526 is tethered to the retainers by a loop of a covered elastic cord 536, a material generally called "shock cord." The manner of attachment of the cord to the retainers and the cover panel to the cord is described below in conjunction with FIGS. 11 to 14.

The last two digits of the reference numerals in FIGS. 11 to 14 designate similar components to those of the other embodiments. The cover panel 626 is of molded fiberglass and is of thin rectangular cross-section, with planar major faces. It is flush-mounted (external surface flush with the main wall surfaces) within recesses formed in the walls adjacent each side of the expansion gap. The reveal surfaces of the recesses in this embodiment are formed by the base portions 624*a* of the retainers 624, which extend out to the side edges of the recesses and have L-shaped edge flange portions 624*b* that define the side edges of the recess and extend out over the edges of the main wallboard panels. A joint compound is applied to the edge flange portions to form a smooth edge finish on the main wall surfaces. Deflectors 640, similar to those described above, are fastened to some of the slide tracks at positions laterally to displace the cover panel by a camming action against the adjacent retainer away from the wall so that the respective side edge of the cover panel clears the side edge of the recess (the flange portion **624*b***) in a seismic event that causes an excursion of the wall relative to the cover panel enough to engage the deflector with the retainer.

Figure 12:
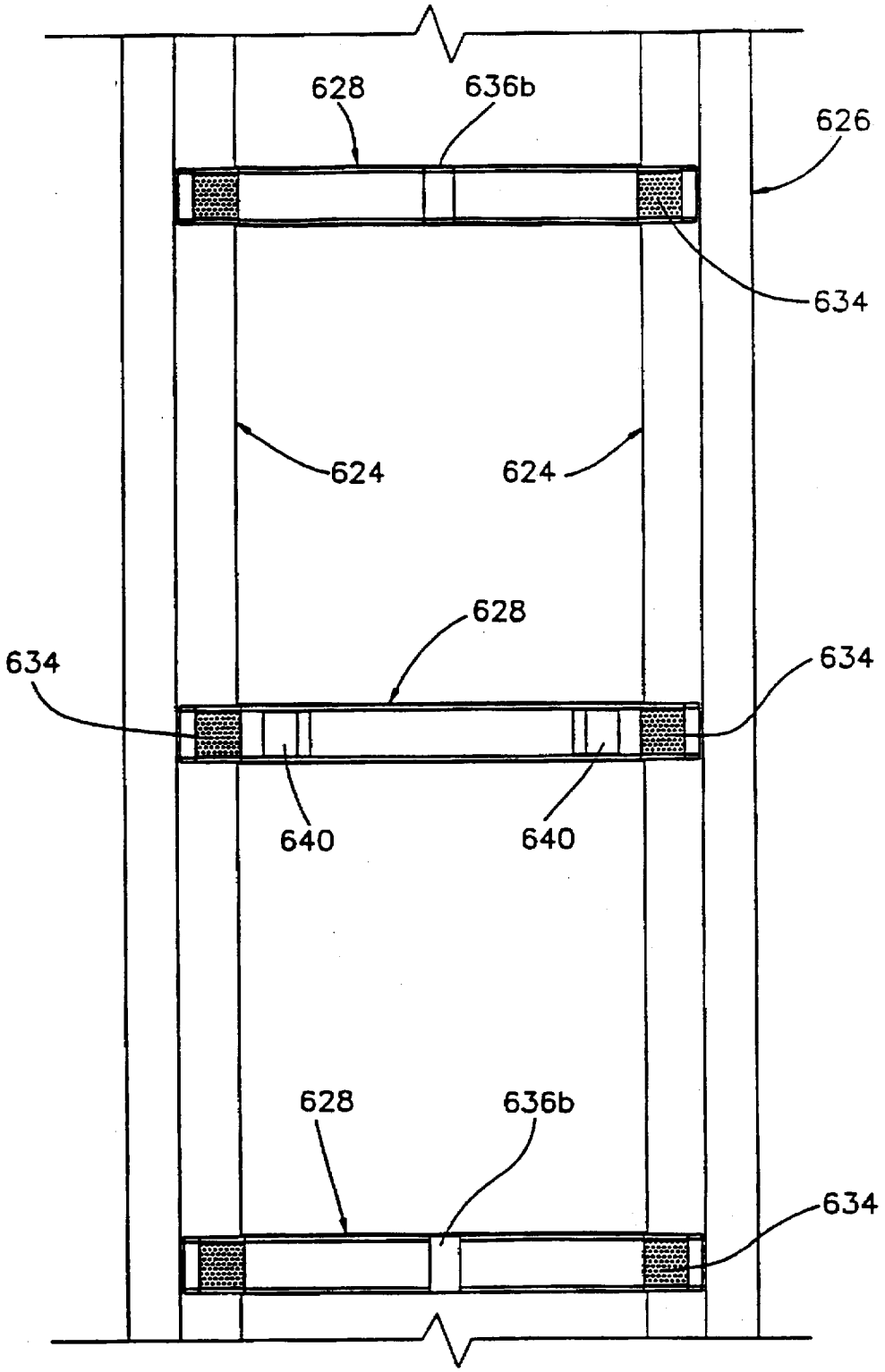
FIG. 12 is a rear side partial elevational view of the cover panel of FIG. 10.
Figure 13:
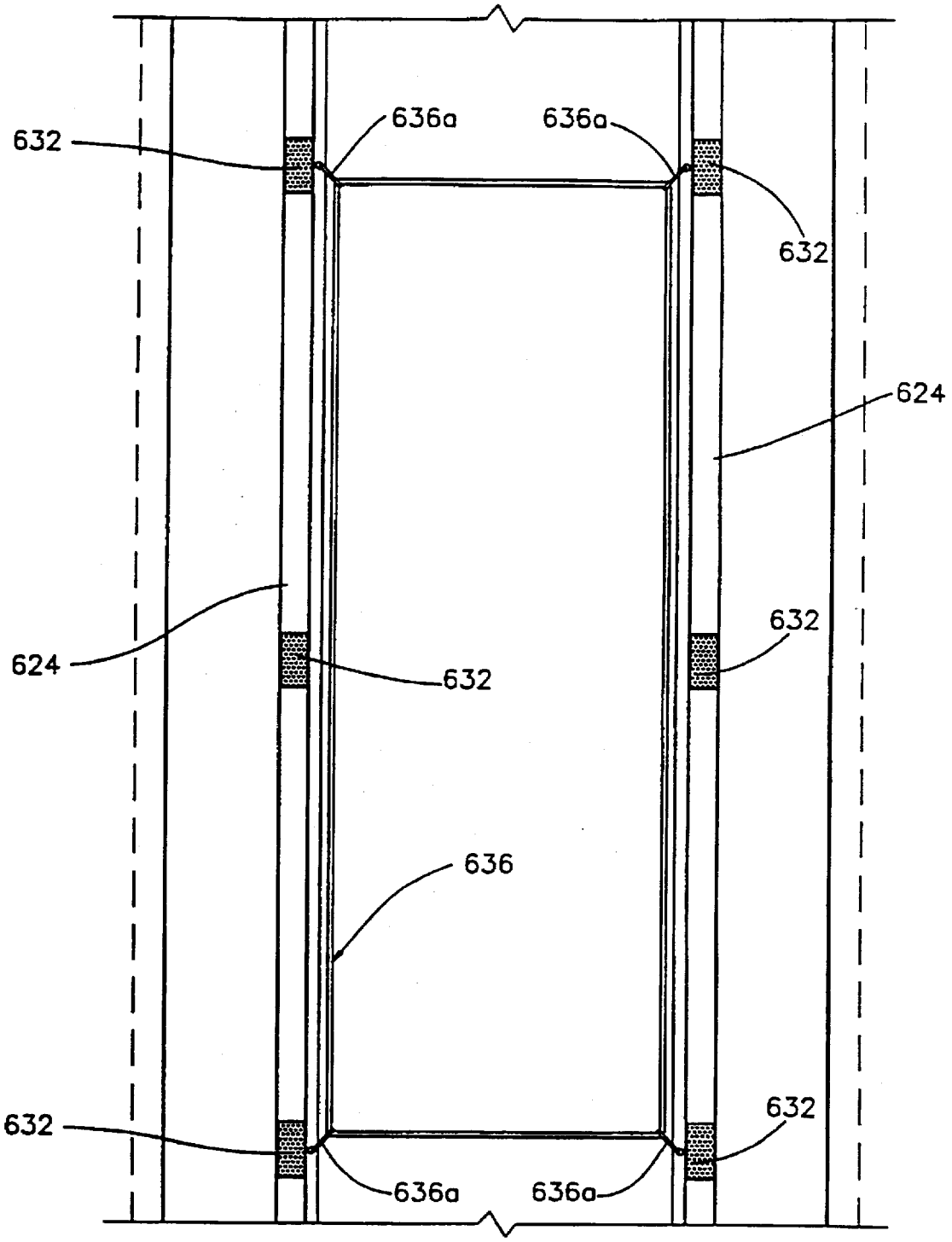
FIG. 13 is a front elevational view of a portion of a wall at the expansion gap and fitted with the retainers an a tether in the form of a loop of elastic cord.
Figure 14:
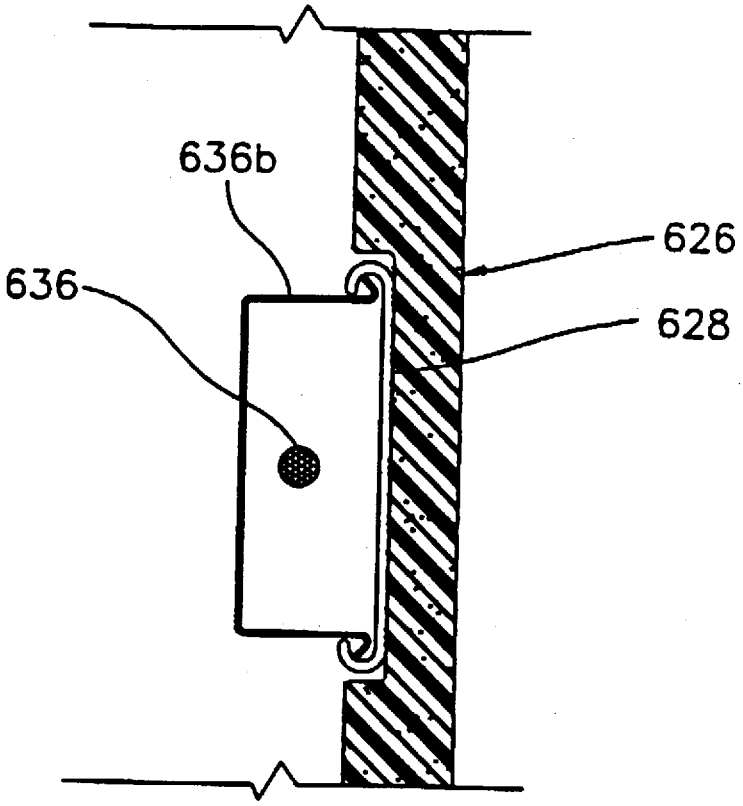
FIG. 14 is a fragmentary cross-sectional view taken along the lines 14–15 of FIG. 11.

A length of shock cord 636 is suitably joined at its ends to form an endless loop, which as shown in FIG. 13 is connected by hooks **636*a* (FIG. 11) to each of the two retainers 624 at two points such that upper and lower transverse segments cross the expansion gap at locations under two of the slide tracks 628 of the cover panel (see also FIG. 12). The cover panel 626 is connected to the shock cord 636 by a U-shaped spring clip 636*b* (see FIG. 14) that is resiliently hooked to the side flanges of the slide track 628 and forms of channel through which the shock cord 636 extends. The spring clip 636*b*** allows the cover panel to be installed after the retainers and the shock cord are in place, the cord being extended out from the wall and the spring clips snapped onto the tracks before the cover panel is fitted to the wall and fastened in place by the hook and loop cloth fasteners.

A desirable configuration for the shock cords 636 and the deflectors 640 is a shock cord having one crossing segments under one slide track, deflectors on the next slide track, and the other crossing segment under the next slide track on the other side of the deflectors, as shown in FIGS. 12 and 13. Such an arrangement avoids conflict between the spring clips and the deflectors and provides a suitably long cord that holds a fairly uniform tension between the open and closed conditions of the expansion gap.

The shock cord 636 is installed with a moderate preloaded tension, so that when the joint narrows, a tension force remains. The shock cord runs freely through the hooks **636*a* and the clips 636*b*, so that the tension is distributed relatively evenly at all times. The segments of the cord 636 that extend across the expansion gap present a barrier or fence that keeps the cover panel from entering into the gap after it is detached from the retainers, even if the gap should widen to a width greater than the width of the cover panel. It is desirable to use two or more shock cord loops, thus providing four or more segments across the expansion gap. In concert with each other, the crossing segments provide a fence for holding a dislodged cover panel with sufficient force to prevent a person from falling into the gap. The shock cord tether of FIGS. 11 to 14 can, of course, be used with any of the embodiments and, indeed is the tethering arrangement of the embodiment of FIG. 10**.

The shock cord tether arrangement of FIGS. 11 to 14 can be modified by training a shock cord (or other flexible element) along other paths, such as diagonally back and forth across the gap and securing its ends. The shock cord can be replaced by one or more non-elastic cords or cables suitably strung across the expansion gap between sliding attachment points to the retainers to form at least two longitudinally spaced-apart crossing segments, attached at each crossing to the cover panel, and maintained under tension by one or more hanging weights or mechanical springs or spring mechanisms.

Figure 15:
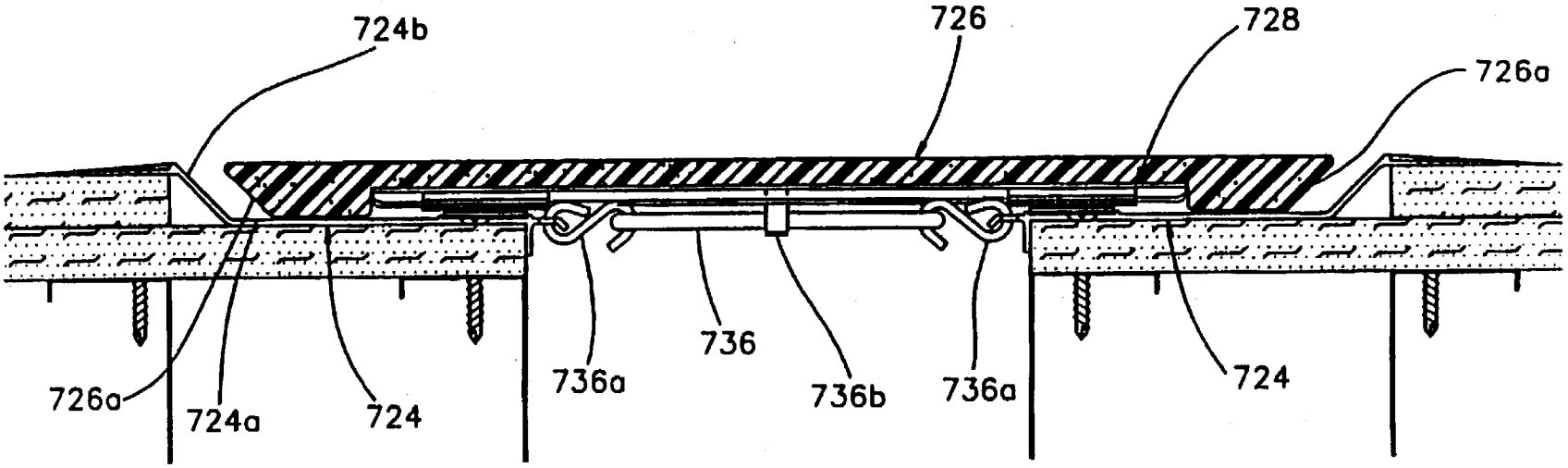
FIG. 15 is an end cross-sectional view of a seventh embodiment, which is another flush-mounted version.

Another way of preventing a damaging collision of a flush-mounted cover panel with the side edges of a wall recess is exemplified by the embodiment of FIG. 15. The side edges **726*a* of the cover panel 726 are beveled such that they slope away from the expansion gap and from the wall recess obliquely to the plane of the wall. The side flanges 724*b* of the retainers 724 are correspondingly sloped. Upon movement of the wall relative to the cover panel that brings one of the beveled edges 726*a* of the cover panel into engagement with the corresponding side flange 724*b*, the engaging sloping surfaces push the cover panel away from the wall by a camming action, thereby avoiding a possibly damaging impact between the cover panel and the side edge of the recess. It is sufficient, of course, for either the side edge of the recess or the side edge of the cover panel to have an oblique surface to provide the camming action for deflecting the cover panel out of the recess. The design of FIG. 15** allows the normal thermal expansion movements to be accommodated while keeping the gap between the side edges of the cover panel and the side edges of the recess small, with correspondingly thin reveal surfaces along the sides of the cover panel.

Figure 16:
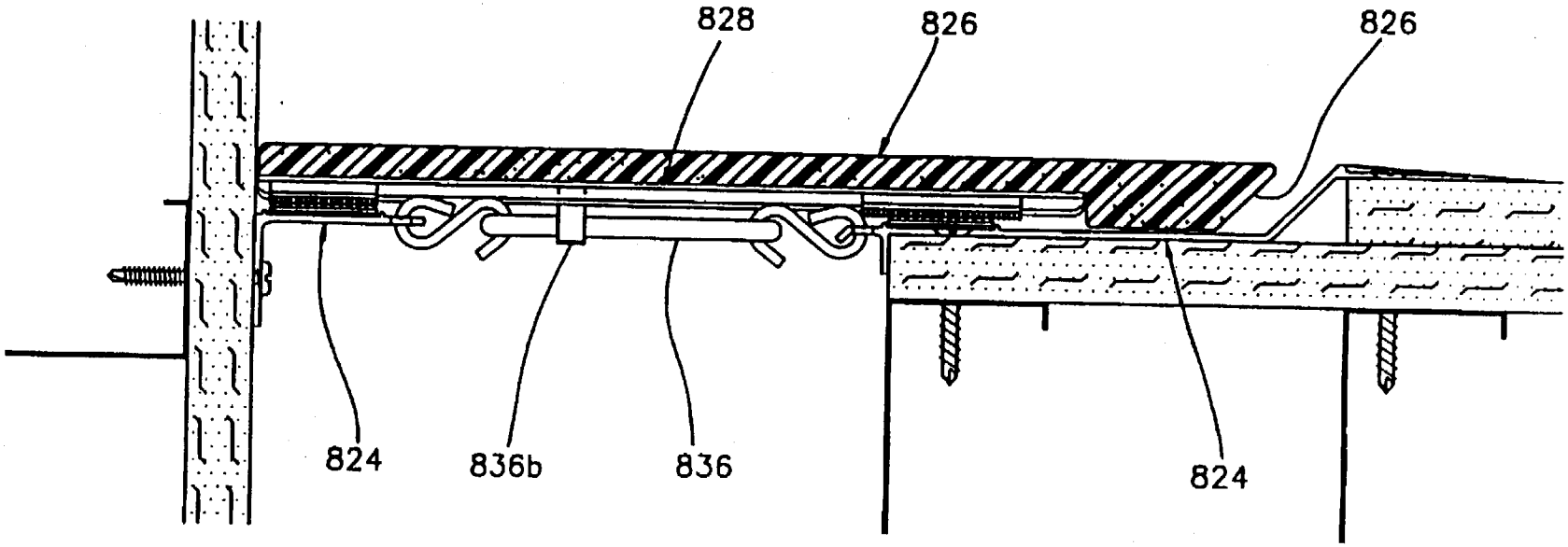
FIG. 16 is an end cross-sectional view of an eighth embodiment, which is flush-mounted and is for use in a gap where an end of one wall meets another wall perpendicular to it, i.e., a corner.

FIG. 16 shows a corner version of the embodiment of FIG. 15. No description is required. Each of the wall to wall embodiments described above and shown in the drawings can easily be reconfigured for a corner application.

Figure 17:
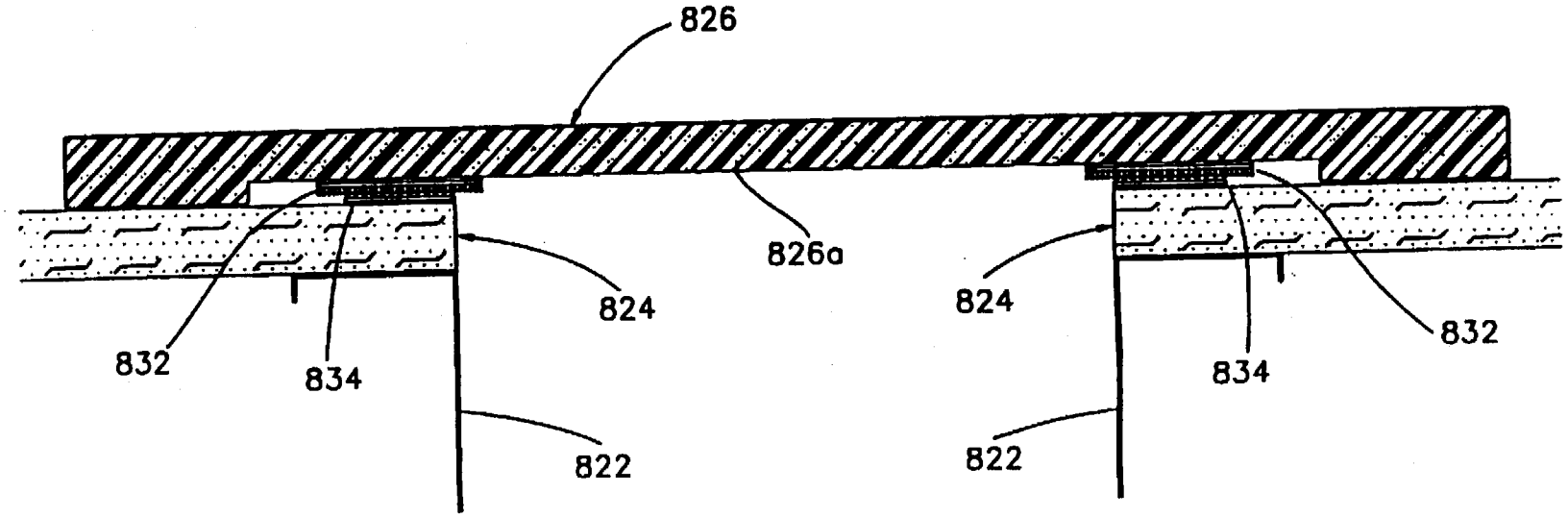
FIG. 17 is an end cross-sectional view of a ninth embodiment of the present invention.

FIG. 17 shows a simplified form of expansion joint cover, which is suitable for installation not only in buildings designed to withstand earthquakes but buildings of conventional design. The cover panel 826, which may be of any of the materials and constructions mentioned above (fiberglass is illustrated), has on its rear surface a recess **826*a* that extends over its full length and is of a depth sufficient to accommodate pieces of hook and loop fasteners 832 and 834 or other axially releasable fasteners, which are located at a suitable spacing. The studs 822 and the drywall panels on either side of the expansion gap serve as the retainers of the expansion joint cover, one element 834** of each of the fasteners being attached directly to the drywall by an adhesive.

The embodiment of FIG. 17 is suitable for expansion joints that have small relative movements due to temperature changes of the building members on opposite sides of the expansion gap; hook and loop fasteners that allow small shear motions without releasing are available commercially. Magnets allow shear motions (sliding) of any magnitude without detachment and can be used in expansion joints that allow relatively large movements. Other axially releasable fasteners (e.g., spring clips) can also be designed to allow large shear movements and are useful in the embodiment of FIG. 17. Where the embodiment of FIG. 17 is used in a geographic area that is prone to earthquakes, the tether arrangements and/or the deflector arrangements described above may be incorporated.

For narrow expansion gaps, expansion joint covers that have axially releasable fasteners between only one of the retainers and the cover panel are entirely adequate. When used with elastic cord tethers, which bias the cover panel toward the wall, good retention of the cover panel is assured, even with relatively wide expansion gaps.

We claim:

1. An expansion joint cover installation, comprising first and second building members defining an expansion gap, an elongated cover panel having a longitudinal axis, an internal face, an external face and side edges, the cover panel having a width transverse to the longitudinal axis such as to span and conceal the expansion gap and to overlie at least a portion of the building member on at least one side of the gap, and releasable fastener means for attaching the cover panel to at least one of the building members and retaining the cover panel in a position concealing and covering the expansion gap, the releasable fastener means being the sole means for retaining the cover panel in said position and being releasable upon application of a force on the cover panel in a direction away from the building members.

2. An expansion joint cover installation according to claim 1 wherein the releasable fastener means includes at least two spaced apart first releasable fasteners joining the cover panel to the first building member, and at least two spaced apart second fasteners joining the cover panel to the second building member.

3. An expansion joint cover installation according to claim 2 wherein the releasable fastener means further includes at least two slide tracks attached to the internal face of the cover panel in spaced-apart relation lengthwise of the cover panel, each slide track being perpendicular to the longitudinal axis and having a portion positioned to overlie the second building member, and a movable slider received in each slide track for movement along the track, and wherein one of said first releasable fasteners joins each slider to the first building member.

4. An expansion joint cover installation according to claim 3 wherein each slide track is recessed into the internal face of the cover panel, and one edge of the cover panel is slidable with respect to a surface of the first building member.

5. An expansion joint cover installation according to claim 4 wherein said surface of the first building is a surface of a recessed portion of a building member, the recessed portion having an edge spaced apart from the expansion gap.

6. An expansion joint cover installation according to claim 3 wherein each slide track extends across the cover panel such that a portion of each slide track overlies the second building member, a non-movable slide member is received in each slide track in said portion and is fixed therein against movement, and one of the second releasable fasteners is connected between a non-movable slider and the second building member.

7. An expansion joint cover installation according to claim 3 wherein edge portions of the internal face of the cover member adjacent the side edges of the cover panel overlie substantially coplanar surfaces of the first and second building members.

8. An expansion joint cover installation according to claim 7 wherein each slide track extends across the cover panel such that a portion of each slide track overlies the second building member, a non-movable slide member is received in each slide track in said portion and is fixed therein against movement, and one of the second releasable fasteners is connected between a non-movable slider and the second building member.

9. An expansion joint cover installation according to claim 7 wherein each slide track is recessed into the internal face of the cover panel, and each edge of the cover panel slidably engages a surface of a building member on a corresponding side of the expansion gap.

10. An expansion joint cover installation according to claim 3 wherein the cover panel has a substantially uniform profile in transverse cross-section along its length and is substantially thicker at the longitudinal axis than adjacent the edges.

11. An expansion joint cover installation according to claim 10 wherein the external face of the cover panel is convexly curved laterally.

12. An expansion joint cover installation according to claim 11 wherein the internal face of the cover panel is substantially planar.

13. An expansion joint cover installation according to claim 1 wherein the cover panel is made of a composite material that includes a fiber filler and a resin binder.

14. An expansion joint cover installation according to claim 13 wherein the fiber filler is fiberglass.

15. An expansion joint cover installation according to claim 13 wherein the external face of the cover panel has a covering of a sheet material that is adapted to receive paint or wallpaper.

16. An expansion joint cover installation according to claim 15 wherein the covering is a textile fabric or paper.

17. An expansion joint cover installation according to claim 1 wherein a portion of the cover panel adjacent at least one of the edges is received in a recessed portion of a building member on one side of the expansion gap, and the edge of the cover panel overlies the recessed portion in slidable relation.

18. An expansion joint cover installation according to claim 17 wherein deflector means is provided for displacing the cover panel out of the recessed portion when an edge of the panel engages or comes close to engaging an edge of the recessed portion.

19. An expansion joint cover installation according to claim 18, wherein the deflector means includes at least one deflector member extending from the internal surface of the cover panel such as to engage a retainer.

20. An expansion joint cover installation according to claim 18, wherein the deflector means includes a sloping surface on either a side edge of the cover panel or a side edge of the recessed portion.

21. An expansion joint cover installation according to claim 17 wherein a flexible gasket is connected between each edge of the cover panel and an edge of a surface adjacent the recessed portion of the building member.

22. An expansion joint cover installation according to claim 17 wherein the cover panel is of substantially uniform thickness throughout and its external surface is substantially flush with said edge of a surface adjacent the recessed portion.

23. An expansion joint cover installation according to claim 1 wherein at least one tethering arrangement connects the cover panel to a member attached to the building member adjacent the expansion gap such as to retain the cover panel proximate to the building member in the event of release of the fasteners.

24. An expansion joint cover installation according to claim 23 wherein the tethering arrangement includes at least two resilient flexible elements that extend across the expansion gap in spaced apart relation and are joined to the cover panel, the flexible elements being biased to pull the cover panel toward the building members and forming a fence that keeps the cover panel from entering the expansion gap.

25. An expansion joint cover installation according to claim 23 wherein the tether is a flexible cable.

* * * * *